US005472572A

United States Patent [19]

White et al.

[11] Patent Number: 5,472,572

[45] Date of Patent: * Dec. 5, 1995

[54] REACTOR FOR BLEACHING HIGH CONSISTENCY PULP WITH OZONE

[75] Inventors: David E. White, Pennington; Michael A. Pikulin, Bound Brook; Thomas P. Gandek, Trenton, all of N.J.; William H. Friend, Savannah, Ga.

[73] Assignee: Union Camp Patent Holding, Inc., Wilmington, Del.

[ * ] Notice: The portion of the term of this patent subsequent to Jan. 26, 2010, has been disclaimed.

[21] Appl. No.: 821,117

[22] Filed: Jan. 15, 1992

Related U.S. Application Data

[63] Continuation-in-part of Ser. No. 604,849, Oct. 26, 1990, Pat. No. 5,181,989.

[51] Int. Cl.[6] ..... D21C 7/00; D21C 9/153

[52] U.S. Cl. ..... 162/241; 162/243; 162/246; 162/65; 422/229

[58] Field of Search ..... 162/52, 57, 243, 162/246, 65, 17, 241; 422/224, 225, 226, 227

[56] References Cited

U.S. PATENT DOCUMENTS

| | | | |
|---|---|---|---|
| 1,591,070 | 7/1926 | Wolf . | |
| 1,642,978 | 9/1927 | Thorne . | |
| 1,643,566 | 9/1927 | Thorne . | |
| 1,781,712 | 11/1930 | Wallace | 162/68 |
| 1,818,913 | 8/1931 | Van De Carr, Jr. . | |
| 1,957,937 | 5/1934 | Campbell et al. | 8/2 |

(List continued on next page.)

FOREIGN PATENT DOCUMENTS

| | | | |
|---|---|---|---|
| 966604 | 4/1975 | Canada . | |
| 970111 | 7/1975 | Canada . | |
| 1103409 | 6/1981 | Canada . | |
| 1119360 | 3/1982 | Canada . | |
| 1132760 | 10/1982 | Canada . | |
| 1112813 | 11/1982 | Canada . | |
| 1154205 | 9/1983 | Canada . | |
| 1181204 | 1/1985 | Canada . | |
| 1186105 | 4/1985 | Canada . | |
| 2012771 | 11/1990 | Canada . | |
| 2022760 | 2/1991 | Canada . | |
| 1310292 | 11/1992 | Canada . | |
| 062539 | 10/1982 | European Pat. Off. . | |
| 106609 | 4/1984 | European Pat. Off. . | |
| 106460 | 4/1984 | European Pat. Off. . | |
| 276608 | 3/1988 | European Pat. Off. . | |
| 308314 | 3/1989 | European Pat. Off. . | |
| 1441787 | 5/1966 | France . | |
| 2620744 | 9/1987 | France | 162/65 |
| 4025616 | 2/1991 | Germany . | |
| 53-31964 | 9/1978 | Japan | 162/65 |
| WO88/05095 | 7/1988 | WIPO . | |

OTHER PUBLICATIONS

Agrawal et al., Performance of Trough Paddle Mixing Conveying System for Treatment of Wheat Straw with Small Volumes of Liquids, p. 18 (No date).

Allison, R. W., "Effect of Ozone on High–Temperature Thermomechanical Pulp", *Appita,* vol. 32, No. 4 (Jan. 1979) p. 279.

Allison, R. W., "Efficient Ozone and Peroxide Bleaching of Alkaline Pulps From Pinus Radiata," *Appita,* vol. 36, No. 1 (Jul. 1982) p. 42.

(List continued on next page.)

*Primary Examiner*—Steve Alvo

*Attorney, Agent, or Firm*—Pennie & Edmonds

[57] ABSTRACT

An apparatus and method for bleaching high consistency lignocellulosic pulp using ozone supplied in an ozone containing gas. The bleaching reactor apparatus according to the invention is a generally cylindrical vessel with a rotatable shaft having radially extending paddles arranged in a configuration to minimize axial dispersion of the pulp and maximize radial dispersion of the pulp to provide a radially dispersed plug flow of pulp through the reactor in the presence of the ozone to provide substantially uniformly bleached pulp.

35 Claims, 8 Drawing Sheets

U.S. PATENT DOCUMENTS

| | | | |
|---|---|---|---|
| 2,013,115 | 9/1935 | Thorne | 8/2 |
| 2,431,478 | 11/1947 | Hill . | |
| 2,466,633 | 4/1949 | Brabender et al. . | |
| 3,318,657 | 5/1967 | Wade | 8/111 |
| 3,630,828 | 12/1971 | Liebergott et al. . | |
| 3,660,225 | 6/1972 | Verreyne et al. | 162/17 |
| 3,663,357 | 6/1972 | Liebergott | 162/65 |
| 3,703,435 | 11/1972 | Schleinofer | 162/17 |
| 3,725,193 | 6/1973 | De Montigny et al. . | |
| 3,785,577 | 1/1974 | Carlsmith | 241/57 |
| 3,814,664 | 6/1974 | Carlsmith | 162/236 |
| 3,832,276 | 8/1974 | Roymoulik et al. | 162/65 |
| 3,964,962 | 6/1976 | Carlsmith | 162/236 |
| 4,046,621 | 9/1977 | Sexton | 162/40 |
| 4,080,249 | 3/1978 | Kempf et al. | 162/57 |
| 4,093,056 | 6/1978 | Richter . | |
| 4,119,486 | 10/1978 | Eckert | 162/65 |
| 4,123,317 | 10/1978 | Fritzvold . | |
| 4,155,806 | 5/1979 | Mannbro | 162/19 |
| 4,158,597 | 6/1979 | Petersson | 162/238 |
| 4,196,043 | 4/1980 | Singh . | |
| 4,216,054 | 8/1980 | Bentvelzen et al. | 162/57 |
| 4,229,252 | 10/1980 | Merredith | 162/57 |
| 4,248,662 | 2/1981 | Wallick | 162/19 |
| 4,274,918 | 6/1981 | Zilka | 162/65 |
| 4,278,496 | 7/1981 | Fritzvold . | |
| 4,279,694 | 7/1981 | Fritzvold et al. | 162/28 |
| 4,283,251 | 8/1981 | Singh | 162/17 |
| 4,298,426 | 11/1981 | Torregrossa et al. . | |
| 4,363,697 | 12/1982 | Markham et al. . | |
| 4,372,812 | 2/1983 | Phillips | 162/40 |
| 4,384,920 | 5/1983 | Markham et al. | 162/19 |
| 4,426,256 | 1/1984 | Johnson . | |
| 4,444,621 | 4/1984 | Lindahl | 162/26 |
| 4,450,044 | 5/1984 | Fritzvold et al. | 162/65 |
| 4,468,286 | 8/1984 | Johnson . | |
| 4,563,243 | 1/1986 | Koch et al. | 162/18 |
| 4,619,733 | 10/1986 | Kooi | 162/30.1 |
| 4,640,782 | 2/1987 | Burleson | 210/748 |
| 4,818,339 | 4/1989 | Lamort | 162/4 |
| 4,913,358 | 4/1990 | Sbaschnigg et al. . | |
| 4,959,124 | 9/1990 | Tsai | 162/49 |
| 5,164,043 | 11/1992 | Griggs et al. | 162/65 |
| 5,181,989 | 1/1993 | White et al. | 162/65 |
| 5,238,501 | 8/1993 | Kappel et al. . | |

OTHER PUBLICATIONS

Allison, "Production of Bleached Softwood Pulp by Low Pollution Processes", Wood Sci. Technol. 17, pp. 129–137 (1983).

Backlund, A., "A Progress Report on Continuous Digester Development", Paper Presented to the 21st EUCEPA International Conference—Torremolinos, Spain (No date).

Balousek, "The Effects of Ozone Upon Lignin Model Containing the B–aryl Ether Linkage", Svensk Papperstidning, No. 9, 1981.

Carlberg et al., "Bleaching of Sulphite and Sulphate Pulps Using Conventional and Unconventional Sequences", TAPPI Proceedings 1982 Annual Meeting, p. 381.

Casey, J. P., "Bleaching: A Perspective", *TAPPI Journal,* vol. 66, No. 7 (Jul. 1983) p. 95.

Dyck, A. W. J., "New Advances in Mechanical Pulping", *American Paper Industry* (Sep. 1971) p. 21.

Eickeler, "Ozone Measurement with Detector Tubes" (No date).

Eriksson and Gierer, "Ozonation of Residual Lignin" (No date).

Fujii, et al., "Oxygen Pulping of Hardwoods," TAPPI, Alkaline Pulping/Secondary Fibers Conference (Washington, D.C., Nov. 7–10, 1977).

Gangolli, "The Use of Ozone and Pulp in the Paper Industry" (No date).

Germgard and Sjorgren, "Ozone Prebleaching of a Modified–Cooked and Oxygen–Bleached Softwood Kraft Pulp", Svensk Papperstidning, No. 15, (1985).

Germgard et al., "Mathematical Modules for Simulation and Control of Bleaching Stages", Nordic Pulp and Paper Research Journal, No. 1 (1987).

Gierer, "Chemistry of Delignification, Part 2: Reactions of Lignins During Bleaching", Word Science and Technology (1986).

Godsay and Pearce, "Physico–Chemical Properties of Ozone Oxidized Kraft Pulps", Oxygen Delignification (1984).

Grant, R. S., "Displacement Heating Trials With a New Process to Reduce Steam", *TAPPI Journal* (Mar. 1983) p. 120.

Gupta, et al., "U.S. Patent Prebleaching, Influence on Viscosity and Sheet Strength", TAPPI Symposium–Oxygen Delignification, p. 1 (1984).

Hill and Rice, "Handbook of Ozone Technology and Applications", Ann Arbor Science (No date).

Hiraoka et al., "Two Dimensional Model Analysis of Flow Behavior of Highly Viscous Non–Newtonian Fluid in Agitated Vessel With Paddle Impeller", Journal of Chemical Eng. of Japan, p. 56 (No date).

Hiraoka et al., "Two Dimensional Model Analysis of Turbulent Flow in an Agitated Vessel With Paddle Impeller", Chem. Eng. Commun., p. 149 (No date).

Heimburger et al., "Kraft Mill Bleach Plant Effluents: Recent Developments Aimed at Decreasing Their Environmental Impact" (No date).

Heimburger et al., "Kraft Mill Bleach Plant Effluents: Recent Developments Aimed at Decreasing Their Environmental Impact Part II", TAPPI Journal, p. 69, (Nov. 1988).

Katai and Schuerch, "Mechanism of Ozone Attack on Alpha–Methyl Glucoside and Cellulosic Materials" (No date).

Kibblewhite et al., "Effects of Ozone on the Fibre Characteristics of High–Temperature Thermomechanical Pulp", Proceedings of the 1979 International Mechanical Pulping Conference, p. 293.

Kratzl et al., "Reactions of Lignin and Lignin Model Compounds With Ozone", *TAPPI,* vol. 59, No. 11 (Nov. 1976) p. 86.

Leopold, B., "The Pulp Mill of the Future", *Textile and Paper Chemistry and Technology,* p. 239.

Leopold, B., "The Pulping Process—Opportunity or Headache?", Proceedings of IPC Conference, Paper Science and Technology, May 8–10, 1979.

Liebergott et al., "The Use of Ozone or Oxygen in the First Bleaching Stage", *Ozone: Science and Engineering,* vol. 4, p. 109 (1982).

Liebergott, et al., "The Use of Ozone in Bleaching and Brightening Wood Pulps: Part I—Chemical Pulps" (TAPPI 1978), p. 90.

Liebergott, N., "Paprizone Process for Brightening and Strengthening Groundwood", *Paper Trade Journal* (Aug. 2, 1971) p. 28.

Liebergott, N., Technical Paper T214—"Sequential Treatment of Mechanical Pulps at High Consistency with $H_2O_2$ and $O_3$—The Paprizone Process–Effect on Pulp Brightness and Strength", *Pulp and Paper Magazine of Canada,* vol. 73, No. 9, (Sep. 1972) p. 70.
Liebergott, et al., "Bleaching a Softwood Kraft Pulp Without Chlorine Compounds", TAPPI Journal, p. 76, (Aug. 1984).
Liebergott, et al., "Bleaching a Softwood Kraft Pulp Without Chlorine Compounds", pp. 1–10 (No date).
Liebergott et al., "Comparison Between Oxygen and Ozone Delignification in the Bleaching of Kraft Pulps", TAPPI Proceedings—1981 Pulping Conference, p. 157.
Liebergott et al., "Ozone Delignification of Bleach Spruce and Hardwood Kraft, Kraft Anthraquinone, and Soda–Anthraquinone", *TAPPI,* vol. 64, No. 6 (Jun. 1981) p. 95.
Lindholm, "Effect of Heterogeneity in Pulp Bleaching with Ozone", Paperi ja Puu, (Apr. 1986).
Lindholm, "Effect of Pulp Consistency and pH in Ozone Bleaching", Part I (No date).
Lindholm, "Effect of Pulp Consistency and pH in Ozone Bleaching; Part 2", International Oxygen Delignification Conference (1987).
Lindholm, "Effect of Pulp Consistency and pH in Ozone Bleaching", Paperi ja Puu, (Mar. 1987), Part IV.
Lindquist et al., "Ozone Bleaching of Sulfite Pulps", TAPPI Proceedings of the 1982 International Sulfite Pulping Conference, p. 127.
Lindquist, "Ozone Bleaching of Sulfite Pulps", *Svensk Papperstidning* (Nov. 6, 1984) p. 54.
Loras et al., "Bleaching of Sulphite Pulps With Oxygen and Ozone", Report of 1982 International Pulp Bleaching Conference, p. 45.
Loras, V., "Bleachability of Mechanical Pulp", *TAPPI,* vol. 57, No. 2 (Feb. 1974) p. 98.
Mbachu et al., "The Effect of Acetic and Formic Acid Pretreatment on Pulp Bleaching With Ozone", *TAPPI,* vol. 64, No. 1 (Jan. 1981) p. 67.
Melnyk et al., "An Ozone Reactor for Color Removal From Pulp Bleachery Wastes", Chemical Abstracts, p. 434 (No date).
Meredith, "Ozone Mass Transfer Agitated Low Consistency", Wood Pulp, Sep. 9, 1981.
Norden and Simonson, "Ozone Bleaching of Sulphite Pulp—A Pilot Plant Study" (No date).
*Norsk Skogindustri,* "Pilot Scale Research at PFI", (Oct. 1980) p. 228.
N. Soteland, "Bleaching of Chemical Pulps With Oxygen and Ozone," *Pulp and Paper Magazine of Canad* (1974), p. T–153.
Ohnishi, K., "Japan: Pulping, Bleaching", *Pulp and Paper* (Aug. 1978) p. 88.
Ouederni, "Simulation of the Ozone/Lignin Reaction in an Agitated Vessel" (No date).Ow, et al., "Advances In Ozone Bleaching: Part II—Bleaching of Softwood Kraft Pulps With Oxygen and Ozone Combination", TAPPI Symposium—Oxygen Delignification (1984).
Partridge, H., "New Pulp Bleaching Developments", *CEP* (Jun. 1976).
Partridge, H., "An Overview of New Pulp Bleaching Developments" AIChE National Meeting, Paper No. 24a. (Sep. 7–10, 1975).
14–23 (1988).
Perkins et al., "Advances in Ozone Bleaching—Part—Pilot Plant Installations and Proposed Commercial Implementation" (No date).
Pettersson, B. et al. "Advances in Technology Make Batch Pulping as Efficient as Continuous", *Pulp & Paper* (Nov. 1985) p. 90.
PPI, "Naco Straw Pulp", Article, (Apr. 1987).
Procter, A. R., "Ozone for treatment of High Kappa Kraft Pulps", *Pulp and Paper Magazine of Canada,* vol. 75, No. 6 (Jun. 1974) p. 58.
*Pulp & Paper,* "Ozone Bleaching Has Potential For Closing Pulp Mill Water Systems", (Jul. 1978) p. 76.
Rothenberg S. et al., "Bleaching of Oxygen Pulps With Ozone", p. 175 (No date).
Rothenberg S. et al., "Bleaching of Oxygen Pulps with Ozone", *TAPPI Journal* (Aug. 1975) p. 182.
Rothenberg et al., "Ozone Bleaching of Oxygen Pulp", Proceedings of the 1982 Pulping Conference, p. 341.
Rutkowski et al., "Investigations on Bleaching of Sulphate Pine Pulp With Ozone", *Cellulose Chem. Technol.,* vol. 18 (1984) p. 323.
Schuerch, "Organization of Cellulose and Wood, Journal of Polymer Science", No. 2, (1963).
Secrist et al., "Kraft Pulp Bleaching. II. Studies on the Ozonation of Chemical Pulps", *TAPPI,* vol. 54, No. 4 (Apr. 1971) p. 581.
Secrist et al., "Studies on the Ozonation of Chemical Pulps", p. 215 (No date).
Seifert et al., "Engineering Considerations in the Design of Oxygen Reactors", p. 309 (No date).
Singh, "Ozone Replaces Chlorine in the First Bleaching Stage: Advances in Ozone Bleaching—Part I", TAPPI Journal, p. 45 (Feb. 1982).
Singh, "Advances in Ozone Bleaching—Part I: The Ozone Bleaching Process—:Laboratory to Pilot Plant" (No date).
Smook, "Chapter 6—Sulfite Pulping", Handbook For Pulp & Paper Technologists (TAPPI) (No date).
Smook, "Chapter 7—Kraft Pulping", Handbook For Pulp & Paper Technologists (TAPPI) (No date).
Soteland, N., "The Effect of Ozone on Mechanical Pulps", Extended Abstracts of 1976 Canadian Wood Chemistry Symposium, p. 13.
Soteland, N., "The Effect of Ozone on Mechanical Pulps", *Pulp and Paper Magazine of Canada,* vol. 78, No. 7 (Jul. 1977) p. 45.
Soteland, N., "Bleaching of Chemical Pulps With Oxygen and Ozone", Pulp and Paper Magazine of Canada, vol. 75, No. 4 (Apr., 1974) p. 91.
Soteland, N., "Bleaching of Chemical Pulps with Oxygen and Ozone", *Norsk Skogindustri* (Sep. 1978) p. 199.
Soteland, "Comparison Between Oxygen and Ozone Delignification of Sulphite Pulps", TAPPI Symposium–Oxygen Delignification p. 71 (1984).
Tenda et al., "Mixing Characteristics and Optimum Conditions of a Horizontal Gas–Solid Agitated Vessel With Paddle–Blades on Double Parallel Axes", Kogaku, pp. 1–15 (No date).
Tritschler and Shelton, "Commercial Manufacture and Industrial Use of Ozone and an Oxidant" (No date).
Vidal and Molinier, "Ozonolysis of Lignin–Improvement of In Virto Digestibility of Poplar Sawdust", Biomass 16, (1988).
Winardi et al., "Pattern Recognition in Flow Visualization Around a Paddle Impeller", Journal of C. E. in Japan, p. 503 (No date).

REACTOR FOR BLEACHING HIGH CONSISTENCY PULP WITH OZONE

RELATED APPLICATION

The present application is a continuation-in-part of U.S. patent application Ser. No. 07/604,849, filed Oct. 26, 1990, now U.S. Pat. No. 5,181,989.

FIELD OF THE INVENTION

The present invention relates to a reactor apparatus and method for bleaching lignocellulosic pulp with ozone, and more particularly, a reactor including rotating elements to convey radially dispersed pulp particles through an ozone containing gas in a plug flow-like manner.

BACKGROUND OF THE INVENTION

To avoid the use of chlorine as a bleaching agent for pulp or other lignocellulosic materials, the use of ozone in the bleaching of chemical pulp has previously been attempted. Although ozone may initially appear to be an ideal material for bleaching lignocellulosic materials, the exceptional oxidative properties of ozone and its relatively high cost have previously limited the development of satisfactory ozone bleaching processes for lignocellulosic pulps.

Numerous articles and patents have been published related to ozone bleaching of pulp. For example, bleach sequences using ozone are described by S. Rothenberg, D. Robinson and D. Johnsonbaugh, "Bleaching of Oxygen Pulps with Ozone", Tappi, 182–185 (1975) - Z, ZEZ, ZP and $ZP_a$ ($P_a$-peroxyacetic acid); and N. Soteland, "Bleaching of Chemical Pulps with Oxygen and Ozone", Pulp and Paper Magazine of Canada, T153–58 (1974) - OZEP, OP and ZP. Further, U.S. Pat. No. 4,196,043 to Singh discloses a multistage bleaching process utilizing ozone and peroxide with effluent recycle, which also attempts to eliminate the use of chlorine compounds.

Also, various patents disclose vertical bed type reactors for ozone bleaching of pulp in a high consistency range, wherein the pulp is deposited at the top of an essentially quiescent or slowly moving bed and an ozone containing gas is drawn through the bed. For example, Fritzvoid U.S. Pat. No. 4,278,496 discloses a vertical ozonizer for treating high consistency (i.e., 35–50%) pulp. Both oxygen/ozone gas and the pulp are conveyed into the top of the reactor to be distributed across the entire cross-section, such that the gas comes in intimate contact with the pulp particles. The pulp and gas mixture is distributed in layers on supporting means in a series of subjacent chambers. The supporting means includes apertures or slits having a shape such that the pulp forms mass bridges thereacross, which the gas passes throughout the entire reactor in contact with the pulp.

Fritzvoid et al. U.S. Pat. No. 4,123,317 more specifically discloses the reactor described in the aforementioned Fritzvoid '496 patent and Fritzvoid et al. U.S. Pat. No. 4,279,694 discloses a method and system for ozone bleaching of pulp using a reactor apparatus as described in the '496 patent. U.S. Pat. Nos. 3,785,577, 3,814,664 and 3,964,962 to Carlsmith each disclose reactor apparatus employing a vertical design similar to the Fritzvoid devices, with the '664 patent directed specifically to ozone bleaching. The vertical bed type design described in the preceding patents provides unsatisfactory results with regard to bleaching uniformity.

The ozone bleaching reactor disclosed in European patent application No. 308,314 utilizes a closed flight screw conveyor (an "Archimedes screw") wherein the ozone is pumped through a central shaft and injected into the reactor to treat a layer of pulp that is ideally about 10 cm in height. The pulp has a consistency of 20–50%. European patent application No. 276,608 discloses a further device for ozone bleaching of pulp. In this device a double screw machine, with sections of reverse threads, sequentially compresses and expands the pulp, preferably at 40 to 45% consistency, to provide access of the ozone to the pulp fibers.

Ozone readily reacts with lignin to effectively reduce the amount of lignin in the pulp. But it will also, under many conditions, quickly remove excessive amounts of lignin and aggressively attack the carbohydrate which comprises the cellulosic fibers of the wood to substantially reduce the strength of the resultant pulp. For these reasons, and notwithstanding the various disclosures discussed above, the art generally teaches away from ozone bleaching of pulp at high consistency. For example, Lindholm, "Effect of Heterogeneity in Pulp Bleaching with Ozone", Papieri ja Puu, p. 283, 1986, states that the ozone pulp reaction may be "quite heterogeneous" (non-uniform) at pulp consistencies in the range of 30–40%. The heterogeneity is said to be due to part of the pulp receiving greater than average ozone doses while other portions of the pulp do not react at all with the ozone. Also, a recently published Canadian patent application, No. 2,012,771 (published Nov. 10, 1990) discloses a method of bleaching medium consistency pulp with ozone by creating a foam-like mixture of ozone, water and pulp. This application teaches that bleaching at 30% consistency yields worse results than at 10% or 1% consistency due to outer pulp surfaces being overbleached and inside surfaces being unbleached.

A further type of reactor is disclosed in U.S. Pat. No. 4,363,697 to Markham et al. for oxygen delignification of pulp at medium consistency. The Markham device may include a series of screw flights or modified screw flights, with and without paddles, to convey the pulp through a reaction tube in the presence of oxygen. U.S. Pat. No. 4,384,920 to Markham et al. also discloses the use of paddle flights rotated at low speed to convey pulp through the presence of an oxygen gas flow. However, the method disclosed in the Markham patents is generally unsuitable for ozone bleaching reactions due to the much faster reaction rate of ozone and pulp/lignin as compared to that of oxygen and pulp/lignin, and also due to the inability of the device disclosed by Markham to provide uniform gas-fiber contacting and uniform bleaching.

The heterogeneity or non-uniformity problem discussed above may be at least partially overcome by bleaching at medium to low consistency. At medium to low consistency the increased water content allows the ozone to diffuse more evenly through the pulp to increase uniformity. However, the increased water content creates other disadvantages which may outweigh the increased uniformity. The primary disadvantage arises from the increased time required for diffusion of the ozone when there is more water present. This leads to increased ozone decomposition in the water and therefore higher ozone expense as well as poorer bleaching selectivity because of the effects of the ozone decomposition byproducts. The result is that at medium to low consistency greater amounts of ozone are required to achieve results equivalent to high consistency bleaching. However, as understood by persons skilled in the art, there is a practical limit on the amount of ozone that can be dissolved in water due to ozone solubility in water. Therefore, it is often not practical or cost effective to attempt to achieve significant increases in brightness with ozone at medium to low consistency.

Another area related to the present invention is the art of conveying, and in particular, with paddle conveyors. The dimensions of flat paddles for use in various diameter paddle conveyors have been standardized by the Conveyor Equipment Manufacturer's Association ("CEMA") in their bulletin ANSI/CEMA 300-1981, entitled "Screw Conveyor Dimensional Standards". Also, Colijn, "Mechanical Conveyors for Bulk Solids" Elsevier, New York, 1985, may be referred to as general background in conveying. Although typical prior art conveyors are useful for exposing material to reactive environments or for general blending of bulk solids, and a number of references discussed above use various types of conveyors, prior art conveyors in general are not capable of providing the necessary dispersion of pulp into an ozone containing gas in order to achieve an efficient and uniform ozone bleaching reaction and avoid the problems of the prior art discussed above.

SUMMARY OF THE INVENTION

It is therefore an object of the present invention to provide a reactor apparatus and method for effectively bleaching cellulosic pulp at high consistency using ozone to obtain a substantially uniformly increased brightness pulp.

It is a further and more specific object of the invention to maximize exposure of the pulp particles to the ozone while at the same time ensuring that every particle is exposed to ozone for approximately the same amount of time. In this regard the present invention provides a unique structure capable of maximizing radial dispersion of pulp particles into an ozone containing gas phase while at the same time conveying the particles through the gas phase with minimum axial dispersion. This feature ensures that a majority of the pulp particles are suspended in the gas phase and exposed to the ozone each for approximately the same time.

The overall bleaching apparatus according to the invention generally comprises fluffer means, reactor apparatus for bleaching high consistency pulp, pulp de-entrainment means, reaction quenching means and means for receiving and discharging bleached low consistency pulp.

The fluffer means reduces floc size of the pulp and provides the pulp with a decreased bulk density.

The reactor apparatus includes an elongated shell adapted to receive the pulp and the ozone containing gas. Ozone containing gas inlets are provided in a variety of configurations to provide means for introducing a gas flow into the bleaching apparatus and reactor shell. The shell defines a pulp inlet, which receives the pulp from the fluffer, and a pulp outlet. Preferably the shell is cylindrical and approximately horizontal. The reactor apparatus further includes means for conveying the high consistency pulp in a plug flow-like manner through the shell with the pulp radially dispersed across the entire cross-section of the shell such that a majority of pulp particles are suspended in the ozone containing gas to provide a radially dispersed and plug flow-like movement of pulp through the shell.

In a preferred embodiment, the conveying means comprises a first means for conveying the pulp at a first conveying rate followed by a second means for conveying the pulp at a second, lower conveying rate. The pulp entering the inlet is received by the first conveying means at the decreased bulk density provided by the fluffer. The first conveying means acts on the pulp to increase the bulk density and delivers the pulp to the second conveying means at an increased bulk density.

According to a further preferred embodiment of the invention, the conveying means comprises rotating means for conveying the pulp through the shell with a dispersion index of less than about 7 at all rotational speeds of the rotating means less than about 125 rpm. More specifically, the conveying means may comprise a rotatable shaft extending longitudinally through the shell and a plurality of radially extending paddles disposed on said shaft and arranged around the shaft at about 240° spacings in a helical quarter-pitch pattern. In a lesser preferred embodiment, the paddles are arranged around the shaft at about 120° spacings in a helical half-pitch pattern. The paddles may be spaced apart in the longitudinal direction to provide an unswept distance between paddles equal to less than about 0.11 times the rotational diameter of the paddles.

It is also preferred that a preselected number of the paddles have a width less than about 0.3 times the rotational diameter. More specifically, the paddles of the second conveying means should have a width equal to about 0.15 times the diameter while the first conveying means paddles should have a greater width, preferably about 0.3 times the diameter.

The pulp de-entrainment means removes the flow of ozone containing gas from the bleaching apparatus and separates entrained pulp fibers from the ozone containing gas prior to its removal. The de-entrainment means is located to receive the flow of gas from the reactor apparatus shell, whether the flow is cocurrent or countercurrent to the pulp movement.

The quenching means quenches (stops) the ozone bleaching reaction on the pulp by adding water to the pulp. The quenching means is located to receive pulp from the reactor apparatus outlet. Adding water to the pulp also lowers its consistency. The means for receiving the lowered consistency pulp from the quenching means is preferably a tank with an agitating device.

According to the method of the present invention a flow of ozone containing gas and high consistency pulp particles are introduced into an elongated, approximately horizontal shell. Pulp particles are dispersed across the entire cross-section of the shell as they are conveyed through the shell in a plug flow-like manner with a dispersion index of about 7 or less.

DETAILED DESCRIPTION OF THE PREFERRED EMBODIMENTS

Figure 1:
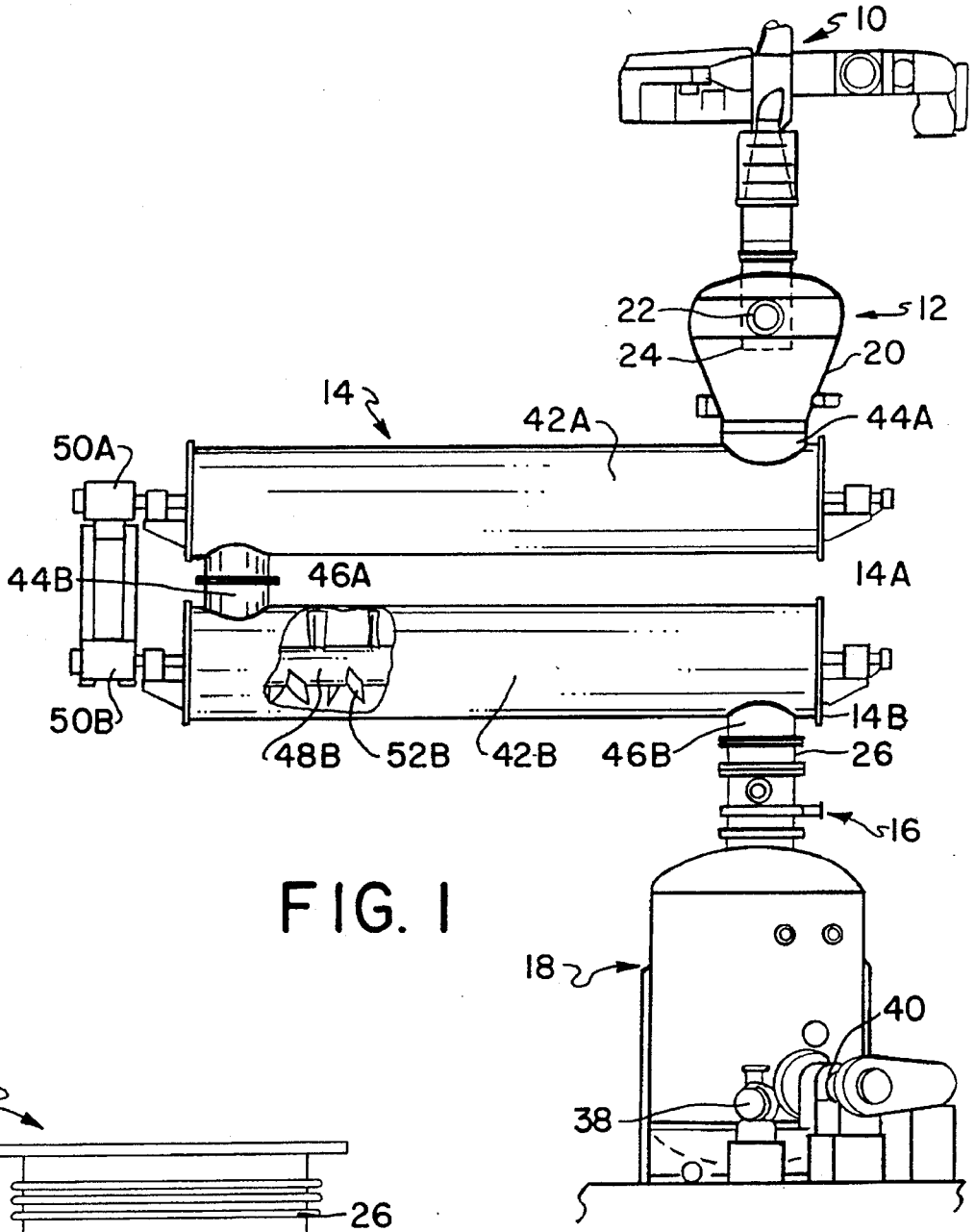
FIG. 1 is a side elevation view of the apparatus according to the present invention with a portion cut away to show the paddle conveyor.

As shown in FIG. 1, the overall apparatus according to the present invention comprises fluffer 10, pulp fiber de-entrainment zone 12, reactor apparatus 14, quenching zone 16 and receiving tank 18. Prior to entering fluffer 10 the pulp passes through a dewatering device (not shown) to control the pulp consistency and a plug screw feeder (not shown) which creates a gas seal to prevent the escape of ozone containing gas.

The pulp entering fluffer 10 is thus a high consistency pulp, generally having a consistency above 20%. Preferably the pulp consistency entering fluffer 10 is in the range of about 28% to 50% and more preferably between about 35% and 45%, with the consistency being ideally about 40%–42%. Fluffer 10 (also known as a comminuter) decreases the bulk density of the pulp and reduces the size of the flocs (individual bundles of pulp fibers) such that a majority of the pulp fibers are contained in flocs less than about 6 mm in diameter and preferably less than about 3 mm in diameter. A number of different devices are commercially available for this purpose and their operation is understood by persons skilled in the art.

After fluffing, the pulp fibers fall vertically through de-entrainment zone 12 and into reactor apparatus 14. The flow of ozone containing gas is countercurrent to the movement of pulp, i.e., pulp moves through the apparatus from fluffer 10 to receiving tank 18, whereas ozone containing gas is added in quenching zone 16 and removed in de-entrainment zone 12. De-entrainment zone 12 includes a frusto-conical or outwardly flared wall portion 20 having a cross-sectional area which increases in the direction of gas flow. This increased area decreases the velocity of the exiting gas to a point where suspended pulp fibers become de-entrained and are not removed with the gas through gas outlet 22. Pulp entering the de-entrainment zone from the fluffer is directed past gas outlet 22 by an internal, cylindrical conduit 24. To prevent back-flow of gas up into fluffer 10, a small flow of ozone containing gas is introduced through the fluffer to maintain flow in the desired direction.

The falling pulp enters reactor apparatus 14 and is conveyed therethrough while simultaneously reacting with ozone supplied in an ozone containing gas to achieve a uniformly bleached, increased brightness pulp as described below. The pulp leaves the reactor apparatus and falls through quenching zone 16 into receiving tank 18.

Figure 2:
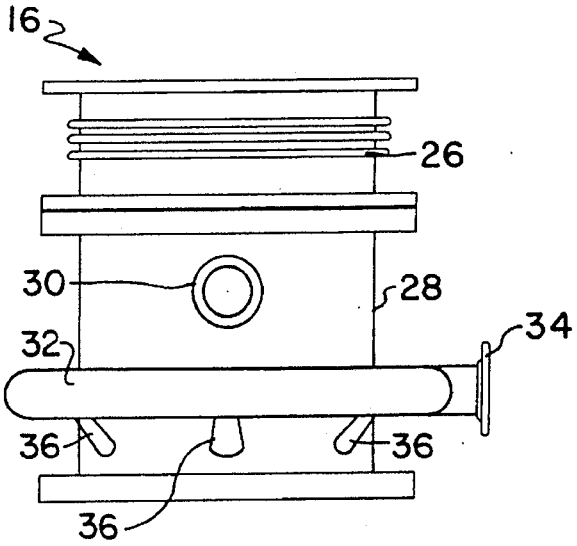
FIG. 2 is an enlarged side elevation view of the quenching zone of the apparatus shown in FIG. 1.

Quenching zone 16, illustrated in FIG. 2, includes an expansion joint 26 that connects the reactor apparatus to a cylindrical section 28. The expansion joint includes an outer folded metal sleeve and an inner cylindrical sleeve to compensate for thermal expansion of the bleaching apparatus. The details of manufacture and operation of such joints are understood by persons of ordinary skill in the art.

Gas inlet 30, for introducing the ozone containing gas, is mounted on section 28. Annular pipe 32 surrounds the lower end of section 28 to supply quenching water. Flange 34 is connected to a water supply. Water from annular pipe 32 is directed into section 28 by nozzles 36 to create a water shower that soaks the pulp and quenches the ozone bleaching reaction on the pulp particles. It is desirable that the quenching occur as uniformly and as quickly as possible in order to preserve the bleaching uniformity achieved in the reactor apparatus. Thus, nozzles 36 are arranged to provide an even , soaking shower of water across the lower end of section 28. Nozzles 36 are also angled downward at an angle of at least 30° with respect to the horizontal and preferably at about 45°, in order to force the pulp down into receiving tank 18 and avoid the formation of a water curtain which would inhibit the free fall of the pulp.

Receiving tank 18 receives the bleached pulp and water added in the quenching zone. The amount of water added reduces the consistency of the bleached pulp to about 3% to form a pulp slurry. Such a slurry may be easily pumped out of the bottom of the receiving tank through pulp outlet 38 for further processing as desired. A propeller inside the tank, operated by shaft 40, agitates the pulp slurry to maintain an approximately uniform consistency at about 3%. A pulp slurry level is maintained in the tank to allow sufficient agitation time to provide a constant discharge consistency and to provide a gas seal that prevents escape of the ozone containing gas at this end of the apparatus.

As explained, in the embodiment of the invention illustrated in FIG. 1, countercurrent flow of ozone containing gas and pulp is contemplated. The ozone containing gas flows from inlet 30 to outlet 22, and the pulp moves in the opposite direction. It is also contemplated that, in an alternative preferred embodiment, ozone containing gas and pulp may move cocurrently through the apparatus. In this case, outlet 22 would become the ozone containing gas inlet and inlet 30 the outlet. Another change from FIG. 1 would be that a de-entrainment zone, such as zone 12, would be incorporated into or adjacent to quenching zone 16. Such modifications are well within the ability of a person of ordinary skill in the art based on the disclosure contained herein and need not be illustrated separately.

Figure 4:
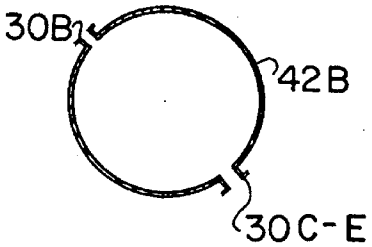
FIG. 4 is a cross-sectional view of the apparatus shown in FIG. 3.
Figure 3:
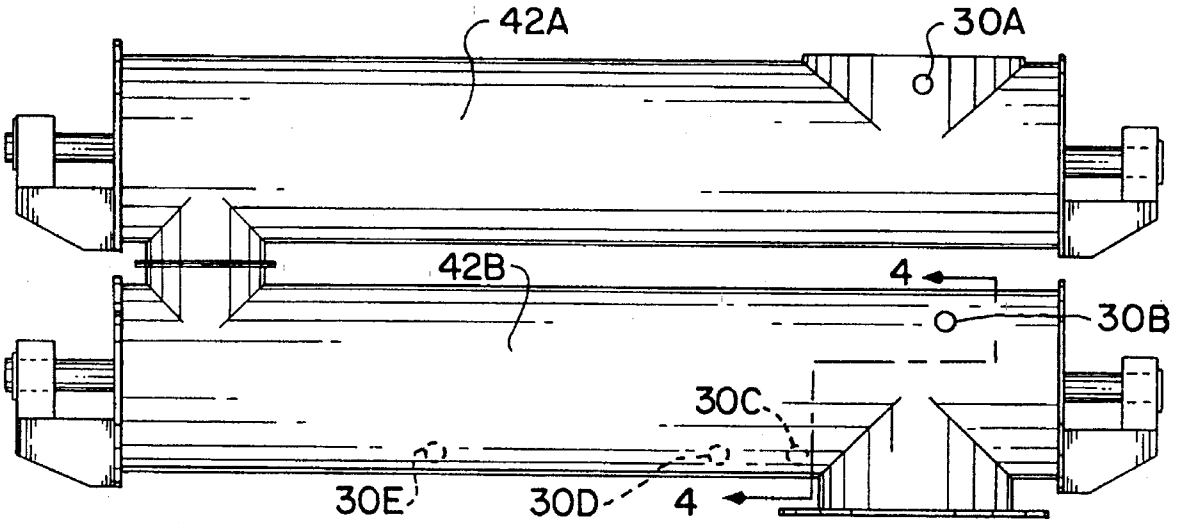
FIG. 3 is a side view of an alternative embodiment of the present invention illustrating multiple port gas inlets.

A further preferred alternative embodiment utilizing multiple port gas entry is contemplated. This may include a distribution of inlet ports around quenching zone 16 or may include multiple ports 30A–E disposed in various locations on the reactor shell such as illustrated in FIGS. 3 and 4. Such ports may be used in various combinations and arrangements to maximize ozone consumption and bleaching efficiency.

The construction and operation of reactor apparatus 14 will now be explained in detail. As shown in FIG. 1, reactor apparatus 14 includes upper and lower sections 14A and 14B. It should be understood, however, that two sections are not a requirement of the present invention. A reactor apparatus according to the present invention may be designed in a single section or in multiple sections depending on various factors, such as the size and capacity of the apparatus and the space available for installation.

Each section 14A and 14B of the reactor includes a generally cylindrical shell 42A and 42B, respectively. Upper shell 42A defines a pulp inlet 44A and a pulp outlet 46A. Pulp inlet 44A is connected to and communicates with de-entrainment zone 12. Lower shell 42B defines a pulp inlet 44B, which is connected to and communicates with upper pulp outlet 46A and a lower pulp outlet 46B connected to and communicating with the expansion joint 26 of quenching zone 16.

Each section 14A and 14B also contains a rotating conveying and dispersing member for conveying the pulp through the shells from inlet to outlet, while at the same time radially dispersing the pulp around the radius of the shell to distribute it across the entire cross-section. In a preferred form, this member comprises rotating shafts 48A and 48B with a plurality of radially extending paddles 52A, 52B, shown in FIGS. 5–8. Shafts 48A and 48B are rotated by motors 50A and 50B, respectively, shown in FIG. 1.

Figure 5:
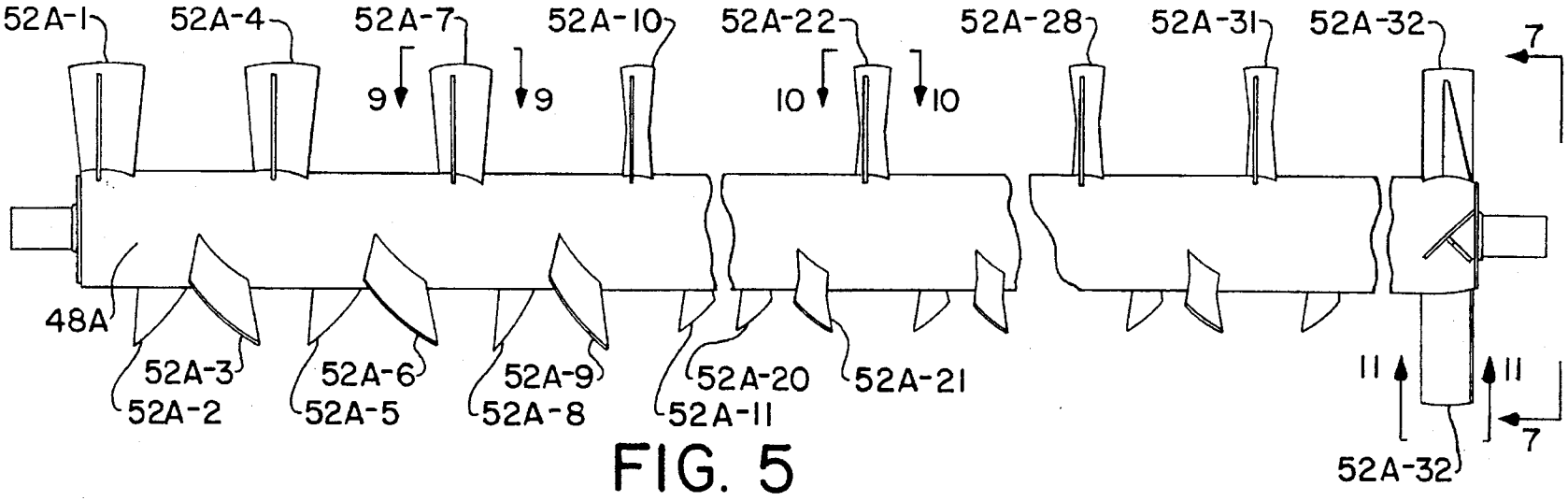
FIG. 5 is a partial side view of the paddle conveyor of the upper section of the reactor apparatus illustrated in FIG. 1.
Figure 6:
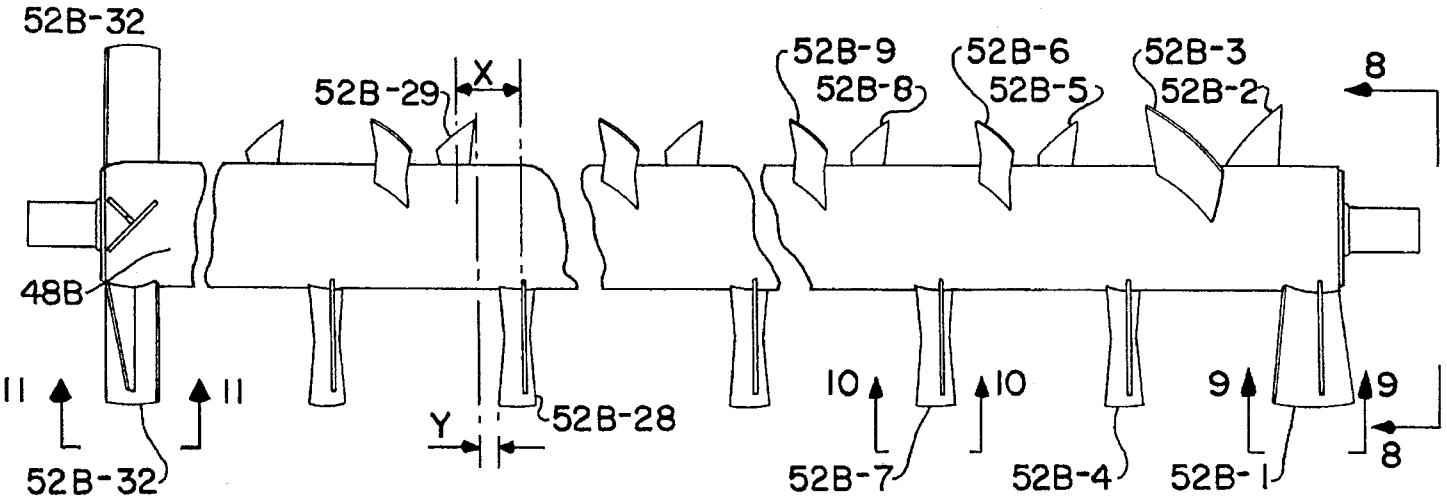
FIG. 6 is a partial side view of the paddle conveyor of the lower section of the reactor apparatus illustrated in FIG. 1.

In order to provide improved ozone bleaching effectiveness and uniformity, a unique arrangement of paddles has been devised. Referring to FIGS. 5 and 6, each shaft 48A, 48B includes thirty-two paddle positions, with each position including a single paddle (except for the thirty-second which includes four paddles). The paddles are designated in FIGS. 5 and 6 according to their position, e.g., a paddle on the lower shaft at position 28 is designated 52B-28. For convenience of illustration, repetitive portions of the shafts in FIGS. 5 and 6 have been broken away such that all paddle positions are not shown.

The paddles on each shaft may be divided into three general zones: feed zone, reaction zone and end zone. The first paddle of the feed zone, 52A-1 and 52B-1, is located under pulp inlets 44A and 44B, respectively. The end zone paddles, 52A-32 and 52B-32, are located immediately after pulp outlets 46A and 46B, respectively. On upper shaft 48A, the feed zone comprises paddles 52A-1 through 52A-9 and the reaction zone comprises paddles 52A-10 through 52A-31. On lower shaft 48B, the feed zone comprises only paddles 52B-1, -2 and -3, and the reaction zone comprises paddles 52B-4 through 52B-31. The paddles in the feed and reaction zones are preferably arranged at 240° spacings in a helical quarter-pitch pattern. The end zone includes only paddle position –32. Four paddles are located at this position with a reverse angle (shown in FIG. 11 as preferably about 45°).

Figure 9:
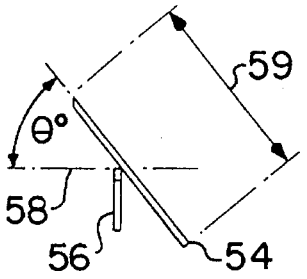
FIG. 9 is an end view of a typical feed zone paddle as viewed along line 9—9 in FIGS. 5 and 6.
Figure 7:
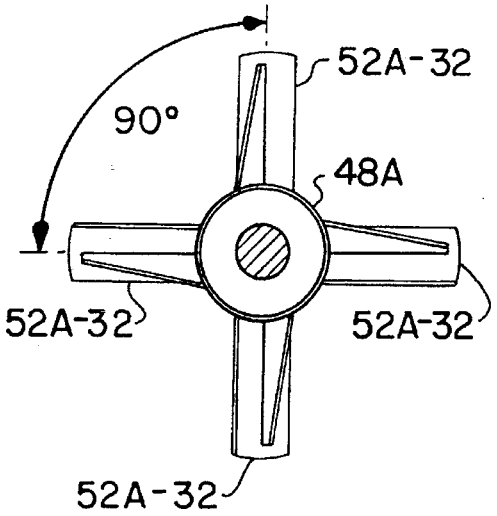
FIG. 7 is a sectional end view of the paddle conveyor shown in FIG. 5 as viewed along line 7—7.
Figure 10:
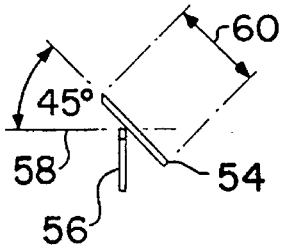
FIG. 10 is an end view of a typical reaction zone paddle as viewed along line 10—10 in FIGS. 5 and 6.
Figure 8:
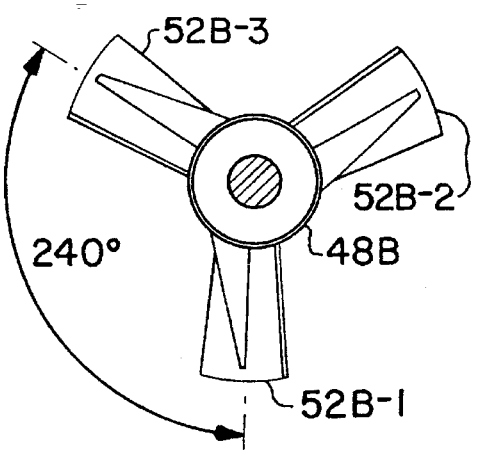
FIG. 8 is a sectional end view of the paddle conveyor shown in FIG. 6 as viewed along line 8—8.
Figure 11:
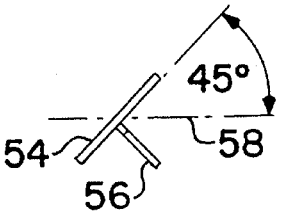
FIG. 11 is an end view of a typical end zone paddle as viewed along line 11—11 in FIGS. 5 and 6.

As shown in FIGS. 9–11, each paddle comprises a blade 54 and support 56. The feed zone paddles are illustrated in FIG. 9. These paddles are standard full size CEMA paddles, that is, blades 54 have the same surface area as specified by CEMA for a standard paddle in a paddle conveyor having the same diameter as the reactor shells 42A and 42B according to the present invention. Thus, as illustrated in FIG. 9, dimension 59 is approximately the same as for a standard CEMA paddle. As also illustrated in FIG. 9 and shown in Table I, contrary to CEMA teachings the paddle angle (Θ) decreases along the shaft in the feed zone.

TABLE I

FEED ZONE PADDLE ANGLES

| UPPER SHAFT 48A | | LOWER SHAFT 48B | |
|---|---|---|---|
| Paddle Position | Paddle Angle Θ | Paddle Position | Paddle Angle Θ |
| 52A-1 | 45° | 52B-1 | 45° |
| 52A-2 | 45° | 52B-2 | 40° |
| 52A-3 | 45° | 52B-3 | 35° |
| 52A-4 | 45° | | |
| 52A-5 | 43° | | |
| 52A-6 | 41° | | |
| 52A-7 | 39° | | |
| 52A-8 | 37° | | |
| 52A-9 | 35° | | |

The paddle angle (Θ) is measured from the centerline 58 of shafts 48A and 48B. Table I gives preferred angles for the feed zone paddles wherein the paddle angle in the reaction zone is preferably about 45°. Generally, paddle angles between about 30° and 50° are useful for the reaction zone of the present invention, in which case, the paddle angles in the feed zone would be adjusted according to the teachings contained herein.

The feed zones provide means for maintaining the fill level of the pulp in the reactor. The fill level of the pulp in the reactor should generally be between about 10 to 50% and preferably about 15 to 40%, with the fill level being most preferably about 20–25%. Fill level refers to the percentage of the volume of the reactor occupied by pulp. However, the pulp does not lie in the bottom of the reactor, but is continuously dispersed throughout the entire volume of the reactor. Maintenance and control of the fill level is important to ensure that sufficient pulp is present to be adequately dispersed in order to efficiently consume the ozone without being over bleached or under bleached.

A particular design for the feed zone is provided because the pulp entering the reactor has had its bulk density significantly reduced in fluffer 10. Thus, the pulp is subject to compaction due to the force of the paddles pushing it through the reactor. Without the feed zone according to the present invention, the fill level of pulp in the reactor would decrease from the inlet to the outlet due to the compaction forces exerted by the paddles. To alleviate this problem, the feed zone of the present invention has a conveying rate higher than the subsequent reaction zone. The conveying rate of the feed zone is tailored by using larger paddles at gradually flatter angles, as illustrated in FIG. 9 and Table I, to first provide a relatively high conveying rate which subsequently decreases to be approximately equal to the conveying rate of the reaction zone. In this manner, the entering pulp, with the lowest bulk density, is conveyed the fastest and the conveying rate decreases gradually as the bulk density increases due to compaction forces. An approximately constant fill level is thereby maintained. In lower reactor section 14B, the feed zone includes only three paddles because the reduction in bulk density is due only to the pulp falling through outlet 46A and inlet 44B and is thus much less than that provided by fluffer 10.

It is in the reaction zones that the bleaching reaction with the ozone primarily occurs; although bleaching will occur to varying degrees throughout reactor apparatus 14, due to the fact that ozone and pulp are present together throughout. The paddles of the reaction zones are specifically designed to maximize ozone consumption and bleaching uniformity while conveying the pulp through the reactor. To this end, the paddles are smaller than standard full size CEMA paddles for conveyors of the same diameter. FIG. 10 illustrates a typical reaction zone paddle, wherein dimension 60 is preferably about one-half standard CEMA size and the paddle angle is approximately 45°. Therefore, the preferred arrangement of the paddles in the reaction zone is 240° spacing in a helical quarter-pitch pattern with half-standard or small size paddles (240-Q-Sm).

It has been discovered in accordance with the invention that two important factors in ozone bleaching of high consistency pulp are (1) that the pulp be distributed throughout the ozone containing gas within the reactor and (2) that, to the greatest extent possible, each pulp fiber reside in the presence of ozone exactly as long as every other pulp fiber. The first factor is referred to herein as radial dispersion and the second factor as plug flow, which results from minimum axial dispersion. It has further been unexpectedly discovered that standard prior art paddle conveyors are not capable of at once satisfying both of these two important factors.

Reactor apparatus 14 according to the present invention maximizes radial dispersion of the pulp such that a majority of the pulp fibers are suspended in the ozone containing gas as they are conveyed through the reactor shells. This means that at any given time during reactor operation, the pulp particles are dispersed across the entire cross-section of the reactor shell with a portion being located around the entire circumference, including the top of the shell, due to the action of the paddles in lifting and tossing the pulp to radially disperse it. Such radial dispersion is in direct contrast to traditional conveyors wherein a majority of the particles being conveyed lie in the bottom of the conveyor. Additionally—and without detracting from the radial dispersion described above— the present invention minimizes axial dispersion of the pulp as it is conveyed through the reactor shell to provide a narrow pulp particle residence time distribution, which, together with the radial dispersion, accounts for the uniform and efficient bleaching of the present invention.

The radial dispersion of the pulp is dependent in part on the centrifugal force imparted to the pulp by the conveyor. Other important factors include, for example, the area and angle of the paddles. The area and angle determine how much of the pulp in the reactor is lifted and tossed, but the amount of centrifugal force determines the degree of dispersion of the pulp which is lifted and tossed. Degree of dispersion refers to the tendency of the pulp to be propelled toward the periphery of the reactor as opposed to simply sliding off of the paddles. In a rotating system such as the pulp bleaching reactor of the present invention, the centrifugal force acting on the pulp is dependent upon the rotational speed and the diameter of the rotating paddles. Based on the teachings of the present invention and the rotational speeds and diameter disclosed herein, a person of ordinary skill in the art could select an appropriate diameter and rotational speed to achieve results comparable to those discussed herein for any size device.

While radial dispersion may be increased using standard prior art paddle conveyors operated at higher than normal rotational speeds, two negative effects arise from the increased speed in a prior art conveyor: First, axial dispersion of the pulp particles increases dramatically. Second, the pulp particles are conveyed at higher speeds such that it is impossible to maintain fill level and residence time in a reactor of reasonable scale. These negative effects defeat the utility of prior art structures as ozone bleaching devices. In addition, the lack of appreciation of these effects appears to be the reason for the absence of commercially successful ozone bleaching devices in the prior art.

In order to correct these two negative effects, the conveying efficiency of the reactor according to the present invention has been reduced relative to prior art conveyors, while improving the axial dispersion performance to approach plug flow over a full range of rotational speeds. This is accomplished by the combination of reduced paddle size, increased helical paddle spacing and reduced pitch. These modifications according to the present invention provide the completely unexpected results of minimizing axial dispersion while reducing the conveying rate to maintain fill level and residence time at high rotational speeds allowing radial dispersion of the pulp. The present invention thus achieves a near perfect plug flow of radially dispersed pulp particles.

The following example illustrates the improved radial and axial dispersion characteristics of the present invention over traditional prior art conveyors. The conveyor/reactor used in this example included a shell twenty feet long with an internal diameter of 19.5". Full pitch for the conveyor was 19" (full pitch is equal to diameter of the conveying elements). The pulp used in the example was partially bleached softwood pulp having a consistency of approximately 42%. The reactor was capable of being modified to use different paddle configurations as shown in Table II.

As previously explained, a key factor in bleaching uniformity is the axial dispersion of the pulp. Axial dispersion may be quantified as the residence time distribution, indicated by the Dispersion Index (DI) in Table II. Perfect plug flow is represented by a DI of zero. A detailed explanation of the method of obtaining DI values using a lithium tracer is contained in the parent application, Ser. No. 07/604,849, filed Oct. 26, 1990, now U.S. Pat. No. 5,181,989, which is incorporated herein in its entirety by reference thereto.

Run A utilized a reactor with paddles arranged according to the reaction zone of the present invention having 240° helical spacings at quarter pitch with half-standard (small) size paddles (240-Q-Sm). Run B utilized a modified paddle conveyor according to a lesser preferred embodiment of the present invention, with standard size paddles arranged at 120° spacings in a helical half-pitch pattern (120-H-Std). Runs C and D utilized a conveyor configured according to the prior art with paddles at 120° helical spacings, full pitch and standard size paddles (120-F-Std). The runs were devised to compare dispersion characteristics and the effect on fill level and residence time for the present invention and the prior art.

TABLE II

| Run | Paddle Type: Paddle Spacing (deg) | Paddle Type: Pitch | Paddle Type: Paddle Size | Paddle Type: Paddle Angle (deg) | Feed Rate (ODTPD) | Paddle Rotational Speed (RPM) | Pulp Fill Level (%) | Avg. Res. Time Pulp (sec.) | Dispersion Index |
|---|---|---|---|---|---|---|---|---|---|
| A | 240 | Quarter | Small | 45 | 18 | 90 | 18 | 45 | 2.6 |
| B | 120 | Half | Stnd | 45 | 20 | 50 | 19 | 44 | 4.8 |
| C | 120 | Full | Stnd | 45 | 20 | 60 | 23 | 52 | 8.9 |
| D | 120 | Full | Stnd | 45 | 20 | 90 | 11 | 25 | 12.5 |

In Run A, according to the present invention, the relatively high rotational speed (90 rpm) provides radial dispersion of the quality required by the invention to expose a majority of the pulp particles to the ozone containing gas. The DI under these operational conditions is 2.6. This is an excellent result which indicates that pulp movement through the reactor approaches plug flow, even while being radially dispersed. Also, the fill level and average residence time resulting from operation at that speed are sufficient to provide good ozone consumption and bleaching uniformity.

Run B illustrates a lesser preferred embodiment of the present invention. This embodiment is lesser preferred primarily due to the fact that in order to maintain the fill level and residence time in the desired ranges the rotational speed must be reduced to about 50 rpm. At this rotational speed the radial dispersion is not of the same quality as with the preferred 240-Q-Sm design, but it is still possible to obtain the radial dispersion necessary for acceptable ozone consumption and brightness increase. However, due to the low DI of 4.8, the 120-H-Std design does have a significant advantage over the prior art as shown in Runs C and D. The 4.8 DI indicates that pulp movement is still approaching plug flow, although, again not as closely as the preferred 240-Q-Sm design.

Runs C and D show the results if a typical prior art paddle conveyor is operated under conditions attempting to achieve the results of the present invention. In Run C, the prior art device was operated at 60 rpm in order to maintain the fill level and average pulp residence time approximately the same as with the present invention. While this speed may allow radial dispersion similar to Run B, the DI is substantially higher than with the present invention. At such a high DI it is not possible to achieve satisfactory uniform bleaching and some of the pulp may be severely degraded due to over bleaching. In an attempt to achieve improved radial dispersion, the rotational speed of the prior art conveyor was increased in Run D to 90 rpm. However, not only do the fill level and average residence time fall to unacceptable levels, the DI increases further, to about 12.5.

In order to understand the teachings of the present invention, as evidenced in Table II, the relationship between radial dispersion and axial dispersion in ozone pulp bleaching according to the present invention must be understood. This relationship may be explained as follows: Once a minimum rotational speed is reached, such that the pulp is at least minimally radially dispersed and not merely pushed along the bottom of the conveyor as in standard prior art conveyors operated at normal prior art rotational speeds, the primary factor affecting bleaching uniformity becomes Dispersion Index. After this minimum point, increased radial dispersion will increase uniformity to a degree, but if pulp movement through the reactor does not approach plug flow any gains due to increased radial dispersion will be effectively lost. For these reasons, as is evident from Table II, although capable of radial dispersion, prior art paddle conveyors are unsuited for ozone pulp bleaching.

Figure 12:
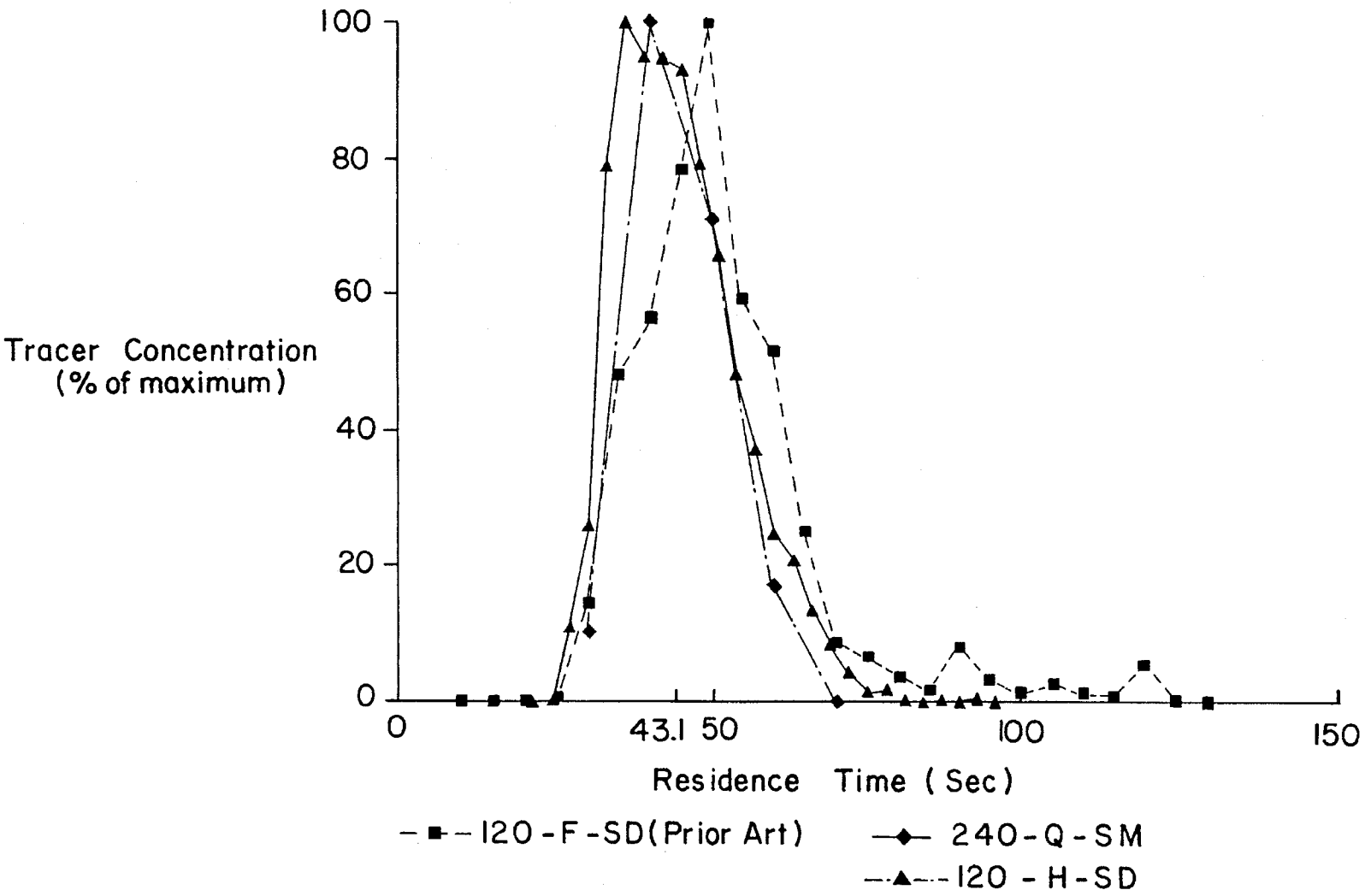
FIG. 12 is a graph of lithium concentration of pulp exiting the reactor versus time after lithium-treated pulp is added at the reactor entrance as an indicator to determine residence time distribution of the pulp for reactors according to the present invention and a conveyor according to prior art.
Figure 13:
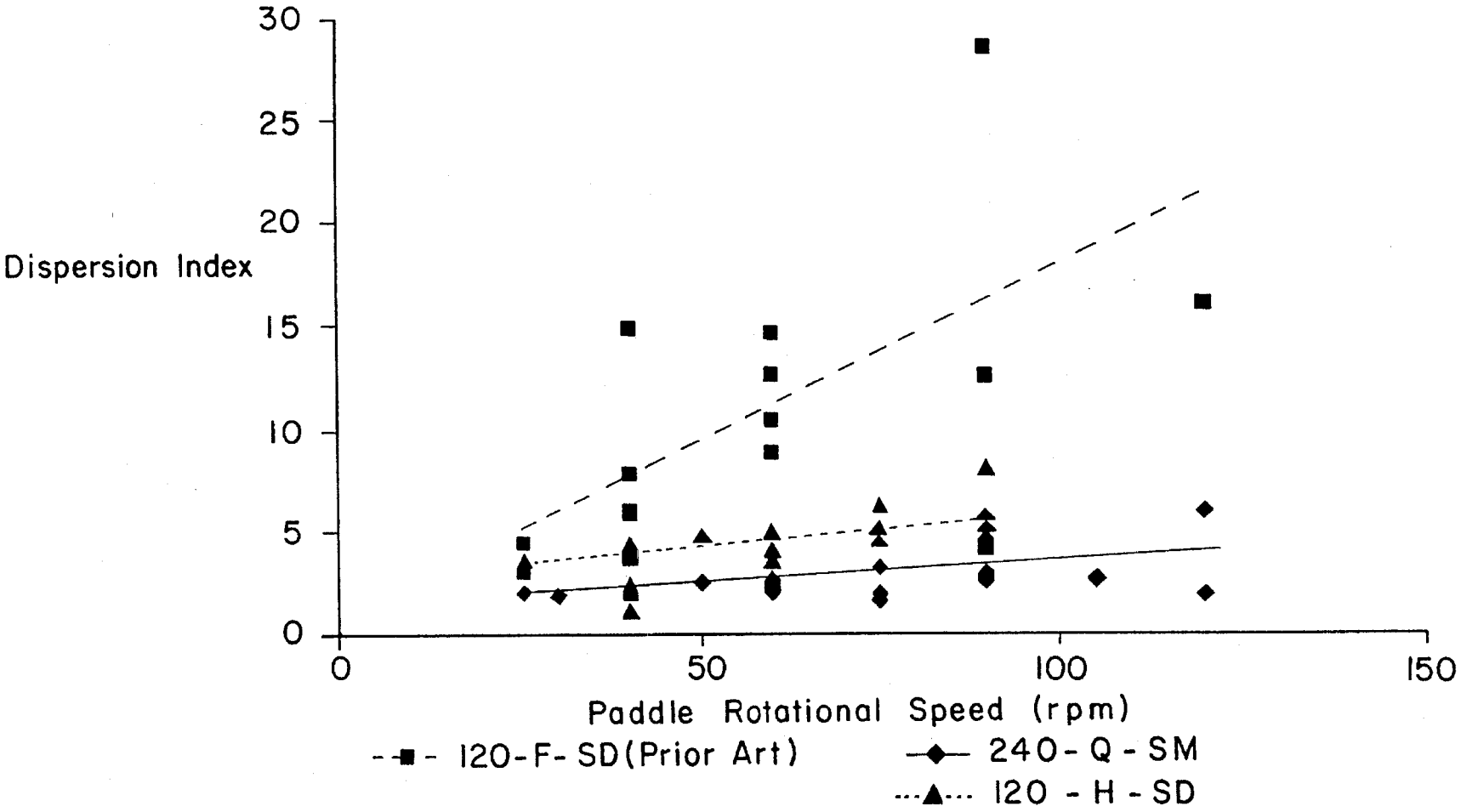
FIG. 13 is a graph of dispersion index versus paddle rotational speed comparing the axial dispersion of reactors according to the present invention with a prior art conveyor.

FIGS. 12 and 13 summarize the data obtained by applicants in their tests comparing the dispersion characteristics of the prior art with the present invention. Although the pulp used to obtain the dispersion data was softwood pulp, dispersion characteristics are not particularly influenced by pulp type. Therefore hardwood and softwood pulps having the same consistency can be expected to exhibit the same dispersion characteristics. FIG. 12 graphically portrays the difference between a DI of 2.6 and 4.8 according to the present invention and a DI of 8.9 in the prior art as shown in runs A, B and C of Table II.

For example, to achieve a desired target brightness of 63% GEB in a hardwood pulp having an entering brightness of 41% GEB with an ozone concentration of 6 wt. % in the ozone containing gas, the residence time for the pulp in the reactor according to the invention should be about 43 seconds. With this target, an acceptable brightness range would be approximately 60–66% GEB. This range of brightness is obtained with residence times between about 30 to 59 seconds. Pulp having a brightness over 66% GEB is overbleached. The presence of a substantial amount of such overbleached pulp would significantly decrease the pulp strength. As illustrated in FIG. 12, at a DI of 2.6, approximately 95% of the pulp falls within the desired residence times. Less than 3% of the total pulp is overbleached. Even in the lesser preferred embodiment of the invention, 88% falls within the desired range. In contrast, the long "tail" on the prior art distribution curve for the prior art conveyor indicates a much greater amount of pulp having a residence time in excess of about 59 seconds. In fact, in the prior art conveyor only about 76% falls within the desired range, and 22% of the pulp has a residence time greater than 59 seconds. The pulp experiencing such high residence times will become overbleached, resulting in nonuniformity, cellulose degradation and loss of strength—detriments associated with ozone bleaching of high consistency pulp in the prior art.

In FIG. 13, the Dispersion Indices for the prior art conveyor are compared to the preferred 240-Q-Sm reactor and the less preferred 120-H-Std reactor of the present invention over a wide range of operational speeds. It can be seen that at low speeds the DI for all three are similar, although still slightly lower for the present invention. However, at low speeds, e.g. 25 rpm, the centrifugal force is not sufficient to provide adequate radial dispersion; the pulp is conveyed mainly along the bottom of the reactor, resulting in inefficient pulp-gas contact so that fibers are not bleached uniformly even though the DI is low. As speed is increased to achieve radial dispersion, the DI of the present invention remains relatively constant, rising to no greater than about 5–7 at about 125 rpm. In contrast, the DI of the prior art conveyor increases rapidly to greater than 20.

One reason for the poor axial dispersion characteristics of the prior art is the existence of a relatively large unswept distance between each paddle, even though the paddles are helically spaced at more frequent intervals and are larger than those of the present invention. The large unswept distances between paddles result in large mounds or ridges of pulp being created in the bottom of the prior art 240-F-Std conveyor shown in FIG. 14A and the 120-F-Stu conveyor shown in FIG. 14B.

FIGS. 14A–B and 15A–B were generated using a 17" diameter conveyor having a plexiglass shell. This conveyor did not have a continuous pulp feed. Instead, the shell was filled with pulp and the conveyor ran until pulp stopped exiting at the end. The stop-action video pictures used for FIGS. 14 and 15 were taken at that point. All of the pulp shown in FIGS. 14 and 15 is sitting on the bottom of the rounded plexiglass shell, essentially without movement in any direction (pulp which appears to be in the air is actually lying on the upwardly curved portion of the back of the clear shell).

Figure 14A:
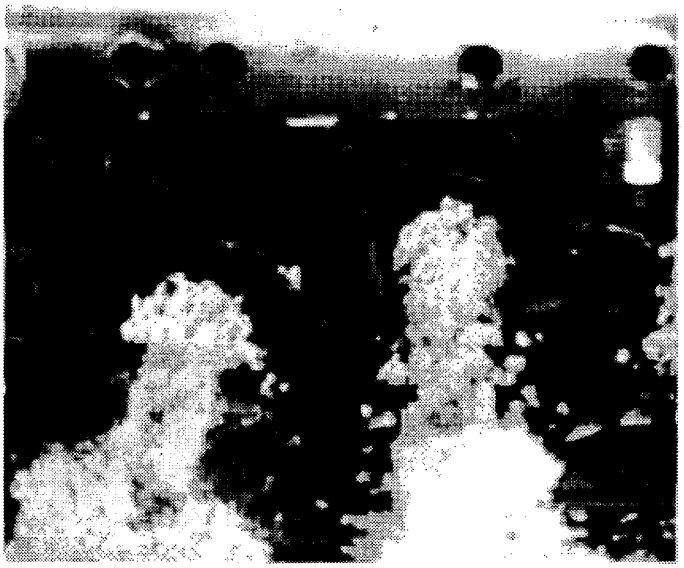
FIG. 14A PRIOR ART
FIGS. 14A and B are printouts from a stop action video looking into a conveyor with paddles configured according to the prior art illustrating pulp mounds and furrows created by relatively large unswept distance.
Figure 14B:
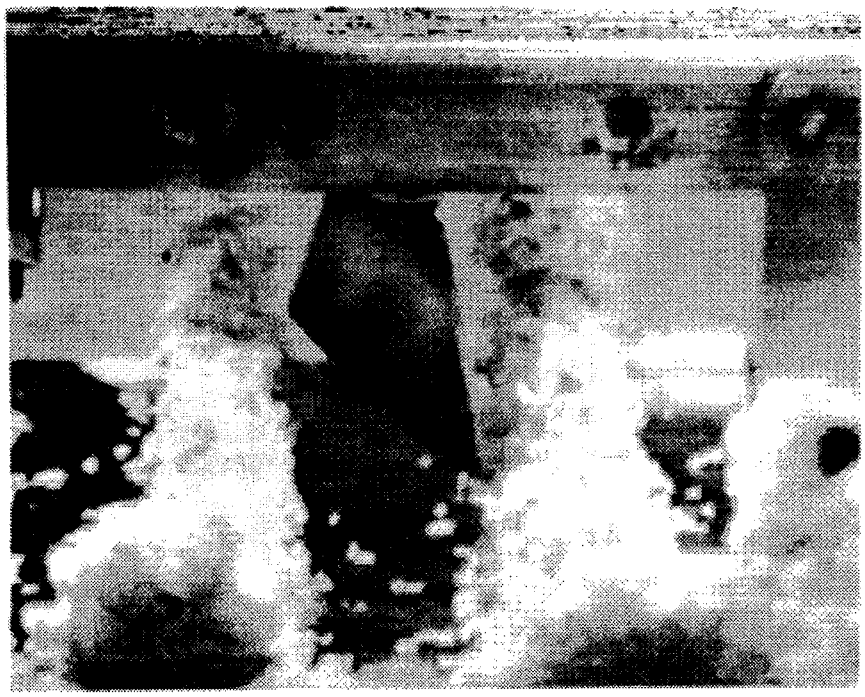
FIG. 14B PRIOR ART
Figure 15A:
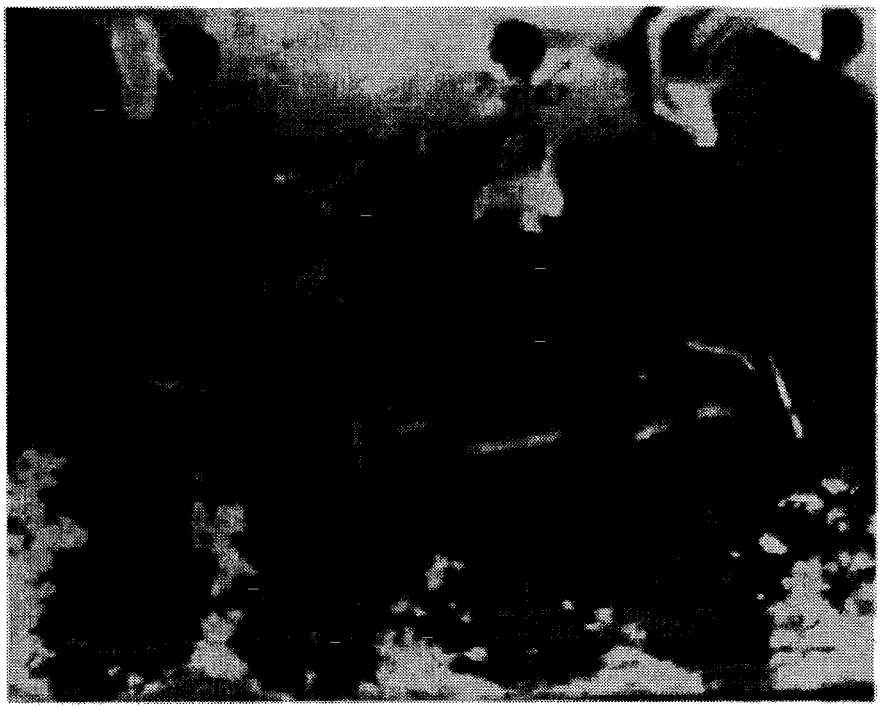
FIGS. 15A and B are printouts similar to FIGS. 14A and B looking into a reactor according to the present invention illustrating the relatively complete pulp removal and even distribution of pulp.
Figure 15B:
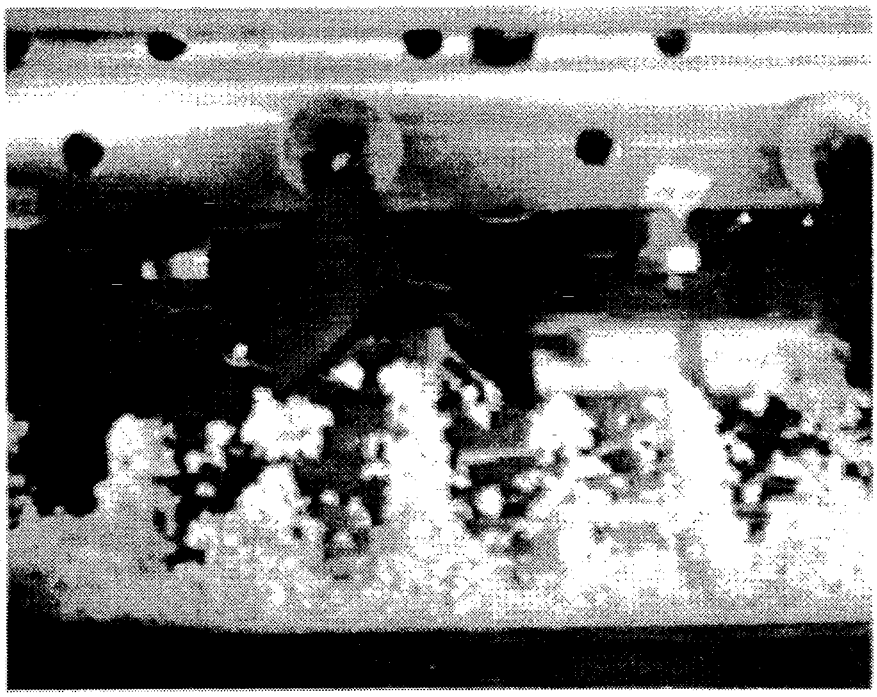

Any differences between FIG. 14A and FIG. 14B, and between FIG. 15A and FIG. 15B, are accounted for by the relatively less clearance used between the end of each paddle and the plexiglass shell in FIGS. 14A and 15A. In FIGS. 14A and 15A this clearance was about ⅛–¼ inch. In FIGS. 14B and 15B the clearance was ¼–⅜ inch. Based on the teachings of the present invention a person of ordinary skill in the art will appreciate the effect such variations in clearance would have on the apparatus according to the invention.

The mounds of pulp shown in FIGS. 14A and B are dead zones, unacted upon by the paddles. Due to the relatively large size of the mounds, a large number of pulp particles become "trapped" in the mounds, while others are moved on by the paddles. The large size of the mounds means that a relatively long period of time is required for all of the pulp particles in a mound to be cycled through the mound and completely displaced by new particles. Displacement allows the original particles of a mound to move to the next mound and thus through the conveyor. This long cycle period for each mound results in the long tail on the prior art distribution curve in FIG. 12. The presence of a large amount of pulp in mounds, unacted on by paddles, also reduces radial dispersion.

In contrast, FIGS. 15A and B illustrate the pulp in a reactor according to the present invention with a 240-Q-sm paddle arrangement. FIGS. 15A and B show that the present invention provides a relatively more uniform distribution of pulp, without the distinct mounds and furrows of the prior art as shown in FIGS. 14A and B. Individual pulp particles move more uniformly through the present invention, without significant numbers being delayed in mounds between paddles. The low Dispersion Indices of the present invention are the result.

The unswept distance may be calculated for any paddle conveyor, providing a useful comparison between the present invention and the prior art. Referring to FIG. 6, paddles 52B-28 and 52B-29, it can be seen that unswept distance Y may be calculated as follows:

$$Y=X-B\cos\Theta$$

where X is the centerline distance between adjacent paddles; B is the paddle width, e.g., dimension 60 in FIG. 10; and Θ is the paddle angle as shown in FIGS. 9 and 10.

Furthermore, it has been observed by the applicants that the dimensions of the prior art standard CEMA paddles generally adhere to the following relationship:

$$B=0.31\sim D$$

where B is again the paddle width; and D is the diameter of the conveyor. This relationship was initially calculated based on CEMA Standard No. 300-008 for conveyor diameters between 6 and 24 inches and is believed to hold true over the full range of diameters. It follows that for small paddles, i.e., one-half standard size, the relationship is:

$$B=0.155D$$

Also, X may be expressed in terms of diameter D (diameter is equal to pitch) as follows:

$$X=D/ppp$$

where ppp is the number of paddles per pitch, in other words, the number of paddles along the shaft in any segment equal in length to the diameter. For example, in a 240-Q-Sm reactor conveyor according to the present invention, ppp=6. In the 120-F-Std conveyor according to the prior art, ppp=3.

Unswept distance Y, therefore, may be expressed in terms of diameter D for any given paddle configuration, based on only paddle angle Θ. Using a paddle angle of 45°, the unswept distance Y in the reaction zone for the present invention is 0.06D. The unswept distance for the prior art conveyor is 0.11D. As such, paddle configurations according to the present invention having an unswept distance less than about 0.11D will provide improved results. Preferably the unswept distance is less than about 0.09 and more preferably about 0.06D or less. Certain paddle configurations will yield negative unswept distance values, indicating overlapping paddles. Such overlapping configurations may be acceptable; however, overlapping paddles also present other difficulties with regard to pulp bridging between paddles. The requirements for paddles spacing to prevent bridging are discussed in detail in the parent application, Ser. No. 07/604,849 now U.S. Pat. No. 5,181,989, and must be seriously considered when dealing with overlapping paddle configurations.

What is claimed is:

1. A bleaching apparatus for ozone bleaching of high consistency pulp particles, comprising a reactor apparatus including:

high consistency pulp particles;

an ozone containing gas;

an elongated shell adapted to receive the pulp particles and ozone containing gas, said shell defining a pulp inlet and a pulp outlet; and means for conveying the high consistency pulp particles in a plug flow-like manner through said shell with said pulp particles being radially dispersed across substantially the entire cross-section of said shell to provide a radially dispersed, plug flow-like movement of pulp through the shell, said conveying means including rotating means and a plurality of paddle members which are spaced apart to provide an unswept distance of about 0.09 times the rotational diameter of the conveyor or less for conveying the pulp through the shall with a dispersion index of less than about 7.

2. The bleaching apparatus according to claim 1 wherein said conveying means comprises first means for conveying the pulp particles at a first conveying rate followed by second means for conveying the pulp particles at a second, lower conveying rate, said first means receiving the pulp particles from the inlet at the first bulk density and delivering the pulp particles to said second means at a second increased bulk density; and where the apparatus further comprises:

means for introducing a flow of the ozone containing gas into the bleaching apparatus for flow through the reactor apparatus shell for reaction with the radially dispersed pulp particles in plug flow-like movement;

pulp de-entrainment means for removing the flow of gas from the bleaching apparatus and separating pulp fibers from said gas prior to removal of the gas, said de-entrainment means disposed to receive the flow of gas from the reactor apparatus shell;

means for quenching the ozone reaction by adding water to the pulp particles and lowering the consistency of the pulp, said quenching means receiving pulp from the reactor apparatus outlet; and means for receiving said lower consistency pulp from said quenching means.

3. The bleaching apparatus according to claim 2, wherein said first and second pulp particle conveying means include said paddle members which are radially extending and mounted in a predetermined arrangement on a rotatable shaft.

4. The bleaching apparatus according to claim 3, wherein paddles and a preselected number of said paddles each has a width less than about 0.3 times the rotational diameter.

5. The bleaching apparatus according to claim 4, wherein a first portion of said preselected number of paddles each has a width equal to about 0.15 times the rotational diameter and a second portion of said number each has a width greater than the first portion, wherein the paddles of the second portion provide the first conveying rate and the paddles of the first portion provide the second conveying rate, wherein the first conveying rate is higher than that of the second conveying rate at any specific rotational speed of the shaft.

6. The bleaching apparatus according to claim 5 wherein each of the paddles is mounted upon the shaft at an angle of between 30° and 50° with respect to a line perpendicular to the shaft centerline.

7. The bleaching apparatus according to claim 2 wherein the second conveying means conveys said pulp particles through the shell to the outlet in a plug flow-like manner at said dispersion index at said rotational speeds of said rotating means under about 125 rpm.

8. The bleaching apparatus according to claim 2, wherein the members are arranged around the shaft at about 240° spacings in a helical quarter-pitch pattern.

9. The bleaching apparatus according to claim 2, wherein said first and second conveying means each comprises radially extending members mounted in a predetermined arrangement on a rotatable shaft.

10. The bleaching apparatus according to claim 9, wherein said radially extending members are paddles and a preselected number of said paddles each has a width less than about 0.3 times the rotational diameter, and each of the paddles is mounted upon the shaft at an angle of between 30° and 50° with respect to a line perpendicular to the shaft centerline.

11. The bleaching apparatus according to claim 9, wherein each of the paddles of the second conveying means has a width equal to about 0.15 times the diameter of the shell and each of the paddles of the first conveying means has a width greater than those of the second conveying means.

12. The bleaching apparatus according to claim 1 wherein said rotating means conveys the pulp through the shell at said dispersion index at all rotational speeds of said rotating means less than about 125 rpm.

13. The bleaching apparatus according to claim 1, wherein said rotating means conveys the pulp through the shell at dispersion index of less than about 5 at all rotational speeds of said rotating means less than about 125 rpm.

14. The bleaching apparatus according to claim 1, wherein the rotating means comprises:

a rotatable shaft extending longitudinally through the shell; and the paddle members include a plurality of radially extending paddles disposed on said shaft to define a rotational diameter of said conveying means, said paddles arranged around the shaft of about 240° spacings in a helical quarter-pitch pattern.

15. The bleaching apparatus according to claim 1, wherein the rotating means comprises:

a rotatable shaft extending longitudinally through the shell; and the paddle members include a plurality of radially extending paddles disposed on said shaft to define a rotational diameter of said conveying means, said paddles arranged around the shaft at about 120° spacings in a helical half-pitch pattern.

16. The bleaching apparatus according to claim 1, wherein said rotating means is operated at a predetermined rotational speed and the dispersion index is about 4.8 or less at the predetermined speed.

17. The bleaching apparatus according to claim 16, wherein the dispersion index is about 2.6 or less at the predetermined speed.

18. The bleaching apparatus according to claim 1, wherein the conveying means comprises a rotatable shaft extending longitudinally through the shell; and the paddle members include a plurality of radially extending paddles disposed on said shaft to define a rotational diameter of the conveying means, said paddles being spaced apart in the longitudinal direction to provide an unswept distance between paddles of less than 0.06 times the rotational diameter.

19. The bleaching apparatus according to claim 18, wherein a preselected number of said paddles each has a width less than about 0.3 times the rotational diameter and each of the paddles is mounted upon the shaft at an angle of between 30° and 50° with respect to a line perpendicular to the shaft centerline.

20. The bleaching apparatus according to claim 18 wherein the conveying means conveys said pulp particles through the shell to the outlet in a plug flow-like manner at said dispersion index at all rotational speeds of said conveying means under about 125 rpm.

21. The bleaching apparatus according to claim 1, wherein said reactor apparatus rotating means comprises first means for conveying the pulp at a first conveying rate followed by second means for conveying the pulp at a second, lower conveying rate; said first means receiving the pulp from the inlet at a first bulk density and delivering the pulp to said second means at a second increased bulk density.

22. The bleaching apparatus according to claim 21, wherein the rotating means comprises:

a rotatable shaft extending longitudinally through the shell; and the paddle members include a plurality of radially extending paddles disposed on said shaft to define a rotational diameter of said conveying means, wherein the paddles of said first means have a surface area greater than the paddles of said second means.

23. The bleaching apparatus according to claim 22, wherein the paddles of the second means have a width approximately 0.15 times the rotational diameter and the paddles of the first means have a width approximately 0.3 times the rotational diameter.

24. The bleaching apparatus according to claim 23, further comprising fluffer means for reducing the floc size of the pulp and providing the pulp with said first bulk density, said fluffer means being disposed vertically above the reactor inlet and communicating with the reactor shell through said inlet for free fall of pulp onto said first conveying means.

25. The bleaching apparatus according to claim 24, further comprising pulp de-entrainment means for separating pulp fibers from said ozone containing gas prior to removal of said gas from the bleaching apparatus, said de-entrainment means including a frusto-conical wall to provide an increasing cross-sectional area and being disposed between the reactor apparatus inlet and said fluffer means for passage of pulp therethrough into the reactor apparatus inlet.

26. The bleaching apparatus according to claim 25, further comprising:

a receiving tank and;

means for quenching the ozone bleaching reaction on said pulp by adding water to the pulp and lowering the consistency of the pulp, said quenching means disposed vertically below the reactor apparatus outlet to receive bleached pulp therefrom and including a plurality of downwardly angled nozzles for forcing the pulp into the receiving tank by a water spray.

27. The bleaching apparatus according to claim 1, wherein:

the reactor shell includes a first approximately horizontal cylindrical section with a first inlet and a first outlet, and a second approximately horizontal cylindrical section with a second inlet and a second outlet wherein the second inlet communicates with the first outlet;

said rotating means includes a first rotatable shaft disposed centrally in the first section of the shell and a second rotatable shaft disposed centrally in the second section of the shell, each of said shafts having said paddle members include radially extending paddles disposed thereon to define a rotational diameter; and the paddles on each shaft are arranged to provide a feed zone followed by a reaction zone wherein said feed zones are located to receive pulp from the respective first and second inlets and the feed zones include paddles providing a conveying rate greater than the conveying rate of the paddles in the respective following reaction zones.

28. The bleaching apparatus according to claim 27, wherein the feed zone paddles have a surface area greater than the reaction zone paddles and the feed zone paddles include paddles having a decreasing paddle angle to provide a decreasing conveying rate along the feed zone such that the conveying rate of the feed zone paddle immediately preceding the reaction zone is approximately the same as the reaction zone conveying rate.

29. The bleaching apparatus according to claim 28 wherein each of the paddles is mounted upon the shaft at an angle of between 30° and 50° with respect to a line perpendicular to the shaft centerline.

30. The bleaching apparatus according to claim 29, wherein the paddle angle gradually decreases along the shaft in the feed zone from about 45° to about 35°.

31. The bleaching apparatus according to claim 1, wherein the ozone containing gas flows countercurrently to the movement of pulp.

32. The bleaching apparatus according to claim 31, wherein the ozone containing gas is supplied into the reactor shell through multiple ports therein.

33. The bleaching apparatus according to claim 1, wherein the ozone containing gas flows cocurrently to the movement of pulp throughout the shell.

34. The bleaching apparatus of claim 1 wherein the paddle members are spaced apart to provide an unswept distance of about 0.06 times the rotational diameter of the conveyor or less.

35. The bleaching apparatus according to claim 1, wherein the rotating means comprises:

a rotatable shaft extending longitudinally through the shell; and the paddle members include a plurality of regularly extending paddles disposed on said shaft to define a rotational diameter of said rotating means wherein a preselected number of said paddles each has a width less than about 0.3 times the rotational diameter.

* * * * *